US008343320B2

(12) United States Patent
Sigrist

(10) Patent No.: US 8,343,320 B2
(45) Date of Patent: Jan. 1, 2013

(54) ELECTROLYTIC ACTING TORCH FOR THE SURFACE WORKING OF METALS

(75) Inventor: Richard Sigrist, Schwyz (CH)

(73) Assignee: EDK S.R.L., Formigine (IT)

( * ) Notice: Subject to any disclaimer, the term of this patent is extended or adjusted under 35 U.S.C. 154(b) by 1207 days.

(21) Appl. No.: 11/883,648

(22) PCT Filed: Feb. 4, 2005

(86) PCT No.: PCT/IB2005/000282

§ 371 (c)(1),
(2), (4) Date: Jun. 11, 2008

(87) PCT Pub. No.: WO2006/082462

PCT Pub. Date: Aug. 10, 2006

(65) Prior Publication Data

US 2009/0127103 A1 May 21, 2009

(51) Int. Cl.
*B23H 7/00* (2006.01)

(52) U.S. Cl. ..... 204/224 R; 205/668

(58) Field of Classification Search ..... 204/224 R; 205/668

See application file for complete search history.

(56) References Cited

U.S. PATENT DOCUMENTS

| | | | | |
|---|---|---|---|---|
| 3,012,921 | A | 12/1961 | Vaughan | |
| 4,174,261 | A * | 11/1979 | Pellegrino | 204/273 |
| 5,600,953 | A * | 2/1997 | Oshita et al. | 60/453 |
| 5,964,990 | A * | 10/1999 | Muratori et al. | 204/224 M |
| 2004/0163948 | A1 * | 8/2004 | Fukunaga et al. | 204/228.7 |
| 2005/0284748 | A1 * | 12/2005 | Dordi et al. | 204/227 |

FOREIGN PATENT DOCUMENTS

| | | |
|---|---|---|
| EP | 0852629 | 7/1998 |
| WO | WO 97/12081 | 4/1997 |

OTHER PUBLICATIONS

International Search Report datedOct. 31, 2005.

* cited by examiner

*Primary Examiner* — Nicholas A. Smith

(74) *Attorney, Agent, or Firm* — McGinn IP Law Group, PLLC

(57) ABSTRACT

The electrolytic action torch (2, 12, 19, 22, 26) for the surface treatment of metals, comprises a nib (4, 11) connected with the unipolar supply of electric current (7) from an external apparatus, the other pole being connected with the metal surface being treated and a device for protecting the operator from the gases and vapors generated, and the protection device consists of a member suitable for providing the area of the nib with a flow of pressurized air (3, 5, 9, 23, 27, 29, 36). Different integrated and non-integrated embodiments of the delivery member of air in the vicinity of the nib are described.

18 Claims, 3 Drawing Sheets

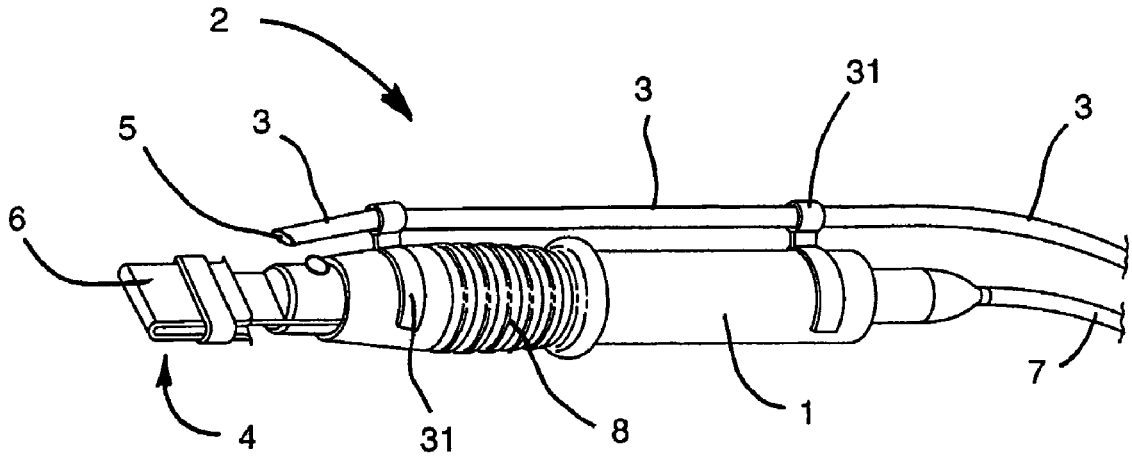
Fig. 1
Fig. 2
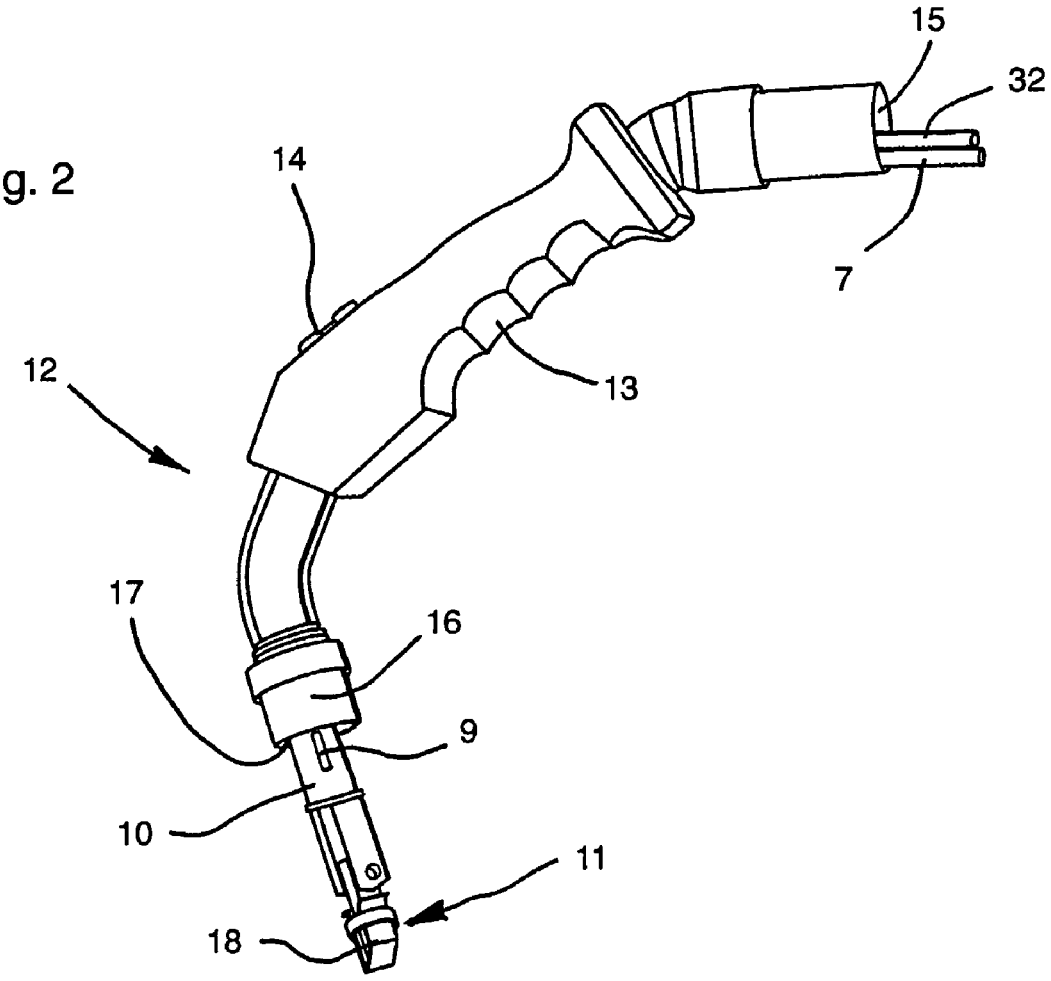

ELECTROLYTIC ACTING TORCH FOR THE SURFACE WORKING OF METALS

The invention concerns: an electrolytic acting torch for the surface treatment of metals, or rather a device in which a nib is taken into contact on the surface of the metal to carry out cleaning, pickling, polishing, electrodeposition or permanent writing with oxidation works on it; said torch has improved devices for protecting the operator from the gases and vapours generated in the aforementioned treatments.

The state of the art comprises electrolytic action devices on the surfaces of metals in which gases and vapours generated in the treatment are sucked into a suction device.

From European patent EP 0 852 629 an electrolytic action torch device for the surface treatment of metals is known in which an electrode with a nib, coated with a pad of fabric made from insulating material impregnated with an acid solution, is fed with low-voltage current and in which the other electrode is connected to the surface of the metal being treated and, to make the operation of the device safer, has suction ports near to said pad, connected with a suction fan for the gases and vapours that form during treatment.

In the state of the art it is known to carry out the polishing, pickling and cleaning treatments of the weldings in the metals under suction hoods, whereas the treatments that are less aggressive on the metal, for example the permanent writing with oxidation, are usually carried out without any protection for the operator.

Moreover, the use of spaces with hoods or areas with suction forces the construction or the adoption of somewhat bulky and expensive apparatuses and, moreover, the operator in his work often finds himself avoiding positioning the metal parts being treated in the correct position for maximum efficiency of said hoods or suction areas.

Furthermore, the device described in patent EP 0 852 629 is bulkier since the efficiency of suction has only been checked with high flow rates of air sucked in; as a consequence of this the suction device adopted by machines constructed according to the patent is of a size suitable for carrying out the required high flow rate.

Therefore, known devices are rather bulky and suitable for high productions and with well-defined working areas that cannot easily be moved. Indeed, the suction devices of the gases and vapours generated in said electrolytic action both due to the configuration—hoods and suction areas in the work environment—and due to the weight and bulk—like the suction integrated into the electrolytic cleaning and pickling machine described in the prior patent—are not very practical and also rather expensive.

Such a state of the art can undergo substantial improvements with regard to the possibility of making an electrolytic action torch for the surface treatment of metals equipped with a device for protecting the operator from the gases and vapours generated in treatment, which whilst being practical in use is simple to assemble in any work place and is not very expensive.

From the above derives the need to solve the technical problem of finding a protection device from the gases and vapours generated in the treatment of the surface of metals that is simple in its construction and easy to use and to assemble.

A further purpose of the present invention is to make a device for protecting the operator from the gases and vapours in the electrolytic action for the surface treatment of metals that is cost-effective in construction, in use and in maintenance.

The invention solves the aforementioned technical problem by adopting: an electrolytic action torch for the surface treatment of metals, comprising a nib connected with the unipolar supply of electric current from an external apparatus, the other pole being connected with the metal surface being treated and a device for protecting the operator from the gases and vapours generated, characterized in that the protection device consists of a member suitable for providing the area of the nib with a flow of pressurized air.

Moreover, by adopting, in a further preferred embodiment: said member consisting of a supply tube of the pressurised air that terminates with a hole aiming towards the nib and said hole advantageously being throttled.

Furthermore, by adopting, in a further preferred embodiment: said supply tube outside the body or shell of the torch and fixed to it; said supply tube, more advantageously, being able to be arranged inside the body or shell of the torch.

By adopting, in a further and different embodiment: in the vicinity of the attachment zone of the nib to the torch, one or more slits or holes for releasing the flow of air aimed towards the nib.

Moreover, by adopting, in a further and preferred embodiment: said pressurised air obtained by connection of the torch to a compressed air distribution apparatus or network; more advantageously, the compressed air distribution apparatus consisting of a motor compressor equipped with an electric motor or a combustion engine.

Furthermore, by adopting, in a further preferred embodiment: in the connection of the torch to the apparatus or network, an electrovalve for controlling the delivery of compressed air to the torch.

Finally, by adopting, in a further preferred embodiment: to constitute said member, between the body of the torch and the support of the nib, a deflector with a prevalently radial position, tilted towards the nib and with a concavity facing towards the nib; a hole positioned between the deflector and the nib releases said flow of compressed air against the concave part of said deflector; advantageously, a ring and a cylindrical support body of the deflector being coaxial to the body of the torch; the hole is made on said ring and constantly orientated towards said concave part of the deflector; the supply of pressurised air advantageously occurring from inside the body of the torch.

BRIEF DESCRIPTION OF THE DRAWINGS

A way of carrying out the invention is illustrated, purely as an example, in the three attached tables of drawings in which:

FIG. 1 is a schematic perspective view of a simple electrolytic action torch on the surface of metals, with a device for dispersing the fumes and vapours according to a first version of the present invention;

FIG. 2 is a schematic perspective view of an electrolytic action torch on the surface of metals combined with the supply pump of the electrolytic solution, with a device for dispersing the fumes and vapours according to a second version of the present invention;

In FIG. 1, to represent a first embodiment of the invention, one can see the body 1 of the torch 2 to which an outer supply tube 3 of the pressurised air that terminates near to the nib 4 of the torch with a hole 5, advantageously partially throttled, suitable for conveying the compressed air in expansion towards the pad 6 that surrounds the nib 4, said tube is supported by brackets 31 a short distance from the body 1. The torch is fed through the electric cable 7 and can be equipped with switches in the handle 8 to stop the electrical feed when the operator dips the nib 4 into the tank with the acid solution used (not shown).

In FIG. 2, to represent a second embodiment of the invention, one can see the slits 9 formed in the inner support body 10 of the nib 11 fed with electricity by the cable 7. The torch 12 is of the type complete with an anatomical handle 13 and buttons 14 for remotely controlling the supply pump (not shown) with the tube 32 of the acid solution used and the electrical supply to the nib: one of said switches can be used to control the supply of compressed air to the slits 9 through the duct 15. A ring 16 is arranged to wrap around the inner body 10 and direct the air coming out and in expansion, with the axial edge 17, from the slits 9 during treatment towards the nib 11 on the pad 18 impregnated with acid solution.

Figure 3:
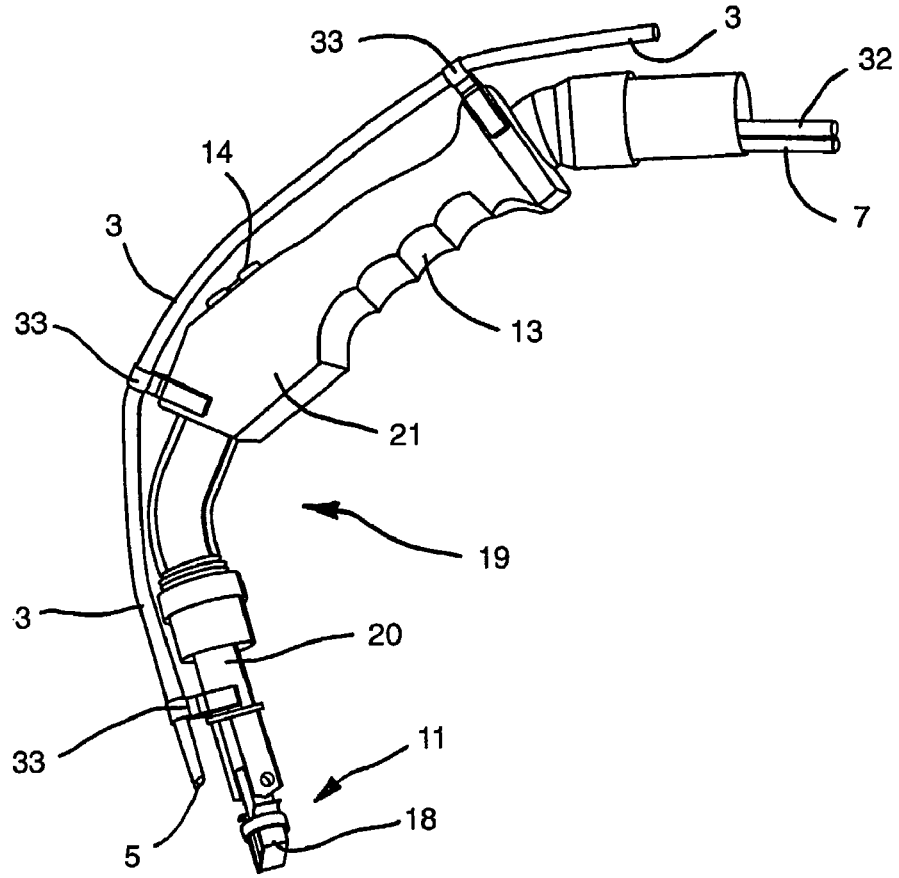
FIG. 3 is a schematic perspective view of an combined electrolytic action torch like FIG. 2 but with the device for dispersing the fumes and vapours according to the first version of the present invention.

The first embodiment, when applied to a complete type torch 19, is made as illustrated in FIG. 3: the outer tube 3 is supported by brackets 33 outside the body 20 of the torch and the shell 21 with the handle 13; the nib 11 is thus subjected to the jet of compressed air in expansion coming out from the hole 5 and directed towards the pad 18. The control of the functions of the torch is carried out through the buttons 14 for the electrical supply from the cable 7, the supply of acid solution, with the tube 32, and of compressed air, with the outer tube 3.

Figure 4:
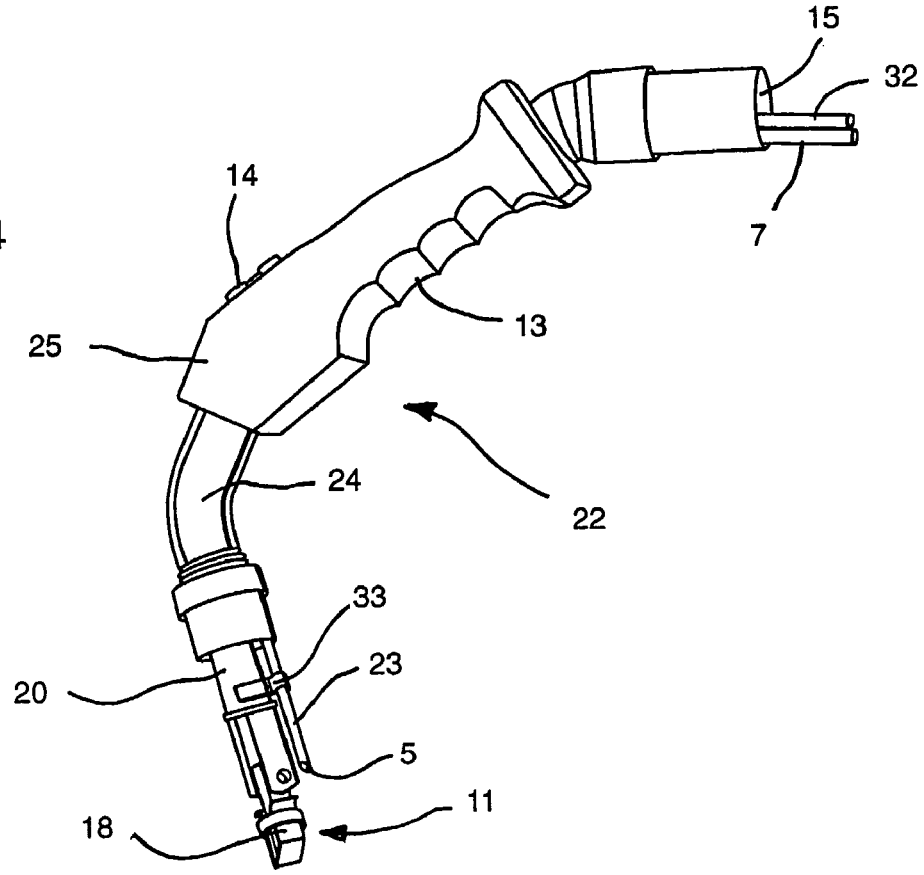
FIG. 4 is a schematic perspective view of an combined electrolytic action torch with a device for dispersing the fumes and vapours according to a third version of the present invention.

In FIG. 4 one can see a third embodiment of the present invention when applied to a complete torch 22: the supply tube of compressed air 23 is arranged inside the outer body 24 of the torch and the shell 25 with the handle 13; the nib 11 is subjected to the jet of compressed air in expansion coming out from the hole 5 and directed towards the pad 18. The control of the functions of the torch is carried out through the buttons 14 for the electrical supply from the cable 7, the supply of acid solution, with the tube 32, and of compressed air, through the duct 15 to which the tube 23 is connected ion the outer body 24 of the torch. Like in the case of the previous figure, the tube 23 can, advantageously, be kept in position by a bracket 33 on the body 20 of the torch.

Figure 5:
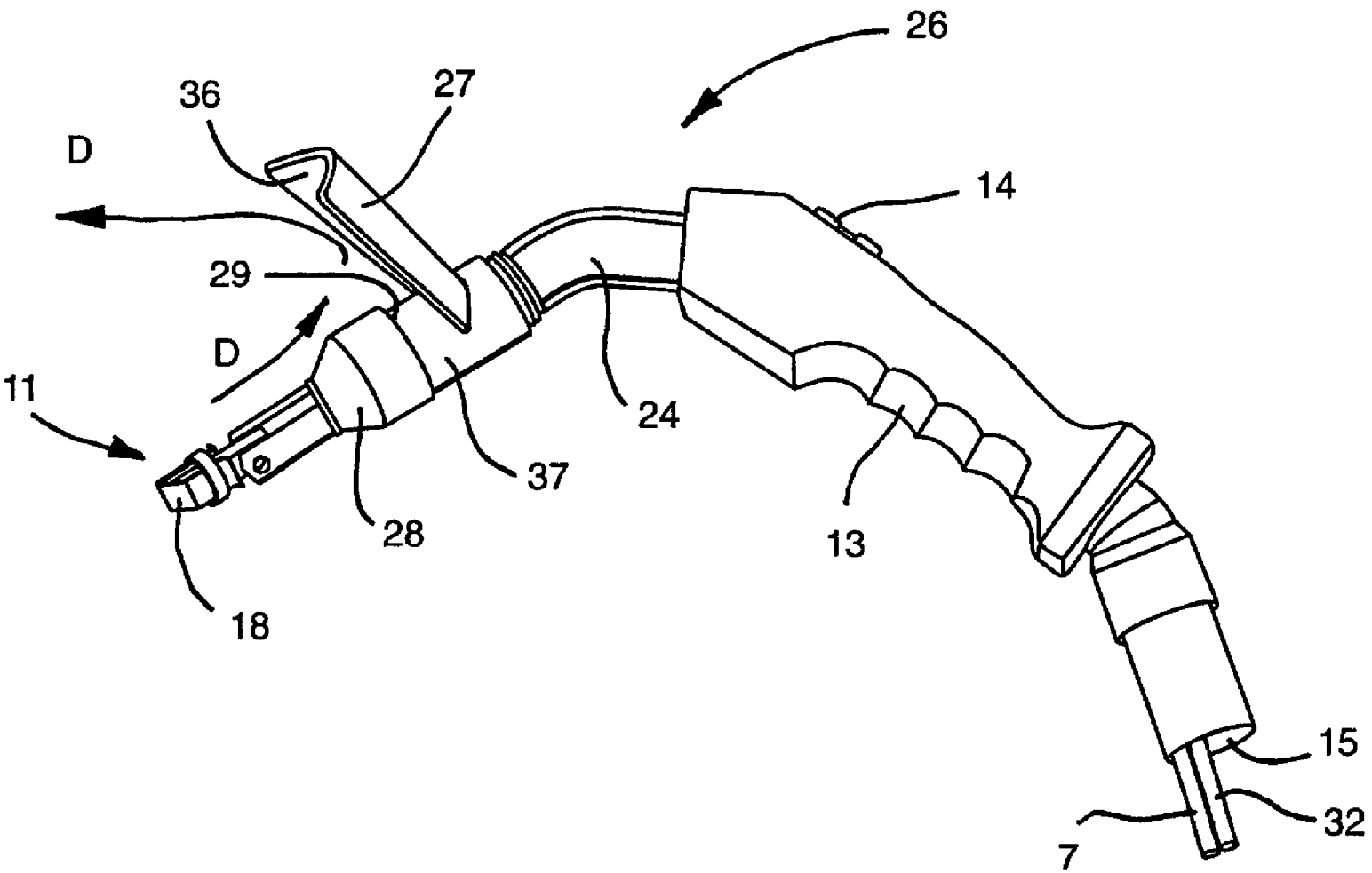
FIG. 5 is a schematic perspective view of an electrolytic action torch on the surface of metals, with a device for dispersing the fumes and vapours according to a fourth version of the present invention.

In FIG. 5, finally, a further embodiment of the present invention is represented, in which the complete torch 26 is equipped with a deflector 27 of the compressed air supplied to the torch by the duct 15. The deflector is housed on the outer body 24 near to the nib 11 with the pad 18. Between the deflector and the nib there is a ring 28 with an outlet hole 29 for the compressed air orientated towards the concave part 36 of the deflector; the ring 28 and the cylindrical body 37 of the deflector are rigidly connected in use to constantly orientate said hole 29 towards said concave part 36. The jet of compressed air coming out from the hole 29, with the rebound on the concave surface 36 of the deflector, generates a motion D of the surrounding air in the opposite direction to the operator. He can control the functions of the torch with the buttons 14 for the electrical supply from the cable 7, the supply of acid solution, with the tube 32, and of compressed air, through the duct 15 to which the hole 29 is connected in the body 37 of the deflector and ring 28 of the torch 26.

The advantages obtained by this invention are: the protection of the operator during the electrolytic action surface treatment of metals is ensured by the jet of air that hits the area of the nib 4, 11 and the pad 6, 18. In the various embodiments illustrated the action of the air in expansion is, indeed, different in the case of a hole 5, which if advantageously throttled, the action of the air condenses the water vapour so as to cool the pad and to prevent the dispersion in the environment of the vapour, which usually partially encapsulates the condensation of the gases generated in the treatment.

On the other hand, in the case of the slits 9, the flow of air generates a gas current in the vicinity of the nib and of the pad such as to obtain similar, but weaker effects: in this case in the tests carried out no condensation of the water vapour was noted, but the evacuation with the dispersion of the gases and vapours was however significant.

In the case of use of the deflector 27, finally, the barrier effect that the jet of air D carries out is comparable and, if the deflector is orientated away from the operator correctly, he is not reached by the motion of the gases and vapours generated in the electrolytic action treatment of the metal surface.

Following tests a longer lifetime of the pad and the condensation of the water vapour in the area of the nib was noted.

The torches thus constructed according to the present invention carry out the protection of the operator from the gases and vapours generated in the electrolytic action surface treatment on metals in a simple, cost-effective and practical manner both in assembly and in use. The pressurised air can be drawn in an any useful and advantageous way for example by connecting the tube 3 or duct 15 to the compressed air distribution network present in industrial plants; in this case it is advantageous to insert an electrovalve for controlling the supply to the torch of compressed air between the network and the torch: it is easily controlled when connected to said buttons for controlling the other functions of the torch. Said compressed air can be produced on site with small electrical motor compressors, so as to ease the actuation with the control of the torch, or a combustion engine for the maximum freedom of positioning of the electrolytic action treatment also in areas outside of industrial plants.

In the practical embodiment the materials, the sizes and the details of embodiment can be different to those indicated, but technically equivalent to them, without for this reason departing from the legal scope of the present invention. Thus, the embodiment of the simple torch 2 of FIG. 1 can have the supply tube of compressed air to the hole 5 made in the shell of the handle 8 to make the operator's grip less awkward. Furthermore, said simple torch 2 can have the deflector 27 and the ring 28 with the hole 29 between the handle 8 and the nib 4 associated with it replacing the supply tube and the hole 5: in this last case the supply of compressed air can advantageously take place from inside said handle 8.

The invention claimed is:

1. An electrolytic action torch for the surface treatment of metals, comprising:

a nib which includes a pad and is connected with a unipolar supply of electric current from an external apparatus, the other pole being connected with a metal surface being treated;

a handle for gripping the torch with one hand; and a protection device for protecting an operator from gases and vapors generated by a surface treatment of the metal surface, the protection device including a member suitable for providing an area of the nib with a flow of pressurized air, wherein a jet of the pressurized air hits the area of the nib and the pad, cooling the pad and inhibiting a dispersion of vapor generated by the surface treatment of the metal surface, and wherein said pressurized air is obtained by connection of the torch to a compressed air distribution apparatus or network.

2. A torch according to claim 1, wherein said member comprises a supply tube of pressurized air that terminates with a hole orientated towards the nib.

3. A torch according to claim 2, wherein said hole is advantageously throttled.

4. A torch according to claim 3, further comprising:

a body, the nib being connected to the body; and a shell formed on the body, the handle being formed on the shell, wherein said supply tube is outside the body or the shell of the torch and fixed to it.

5. A torch according to claim 3, further comprising:

a body, the nib being connected to the body; and a shell formed on the body, the handle being formed on the shell, wherein said supply tube is inside the body or the shell of the torch.

6. A torch according to claim 2, further comprising:

a body, the nib being connected to the body; and a shell formed on the body, the handle being formed on the shell, wherein said supply tube is outside the body or the shell of the torch and fixed to it.

7. A torch according to claim 2, further comprising:

a body, the nib being connected to the body; and a shell formed on the body, the handle being formed on the shell, wherein said supply tube is inside the body or the shell of the torch.

8. A torch according to claim 1, further comprising:

a body, the nib being connected to the body; and in the vicinity of an attachment zone of the nib to the body, one or more slits or holes for releasing the flow of air aimed towards the nib.

9. A torch according to claim 1, wherein the compressed air distribution apparatus comprises a motor compressor equipped with an electric motor or a combustion engine.

10. A torch according to claim 1, further comprising:

an electrovalve for controlling a delivery of compressed air to the torch in the connection of the torch to the apparatus or network.

11. A torch according to claim 1, further comprising:

a body, the nib being connected to the body by a support, wherein said member comprises a deflector between the body of the torch and the support for the nib, said deflector having a prevalently radial position, tilted towards the nib and including a concave part facing towards the nib, wherein a hole positioned between the deflector and the nib releases said flow of pressurized air (D) against the concave part of said deflector.

12. A torch according to claim 11, further comprising:

a ring and a cylindrical support body for the deflector coaxial to the body of the torch, wherein the hole is made on said ring and is constantly orientated towards said concave part of the deflector, a supply of the pressurized air advantageously taking place from inside the body of the torch.

13. A torch according to claim 1, further comprising:

a body, the nib being connected to the body.

14. A torch according to claim 13, further comprising:

a shell formed on the body, the handle being formed on the shell.

15. A torch according to claim 14, wherein the shell comprises a duct for connecting to a pressurized air supply and supplying air to the pressurized air supply member.

16. A torch according to claim 14, further comprising:

an electrical cable for providing the unipolar supply of electrical current to the nib, wherein the shell houses the electrical cable.

17. A torch according to claim 14, further comprising:

an acid solution supply tube for supplying an acid solution to the nib, wherein the shell houses the acid solution supply tube.

18. An electrolytic action torch for surface treating a metal surface, comprising:

a body;

a nib connected to the body by a support, the nib including a pad and being connected with a unipolar supply of electric current from an external apparatus, the other pole being connected with the metal surface being treated;

a shell formed on the body and comprising a handle for gripping the torch;

a control valve formed on the shell, for controlling a delivery of the pressurized air; and a protection device for protecting an operator of the torch from a vapor generated in a surface treatment of the metal surface, the protection device including a pressurized air supplying member for providing an area of the nib with a flow of pressurized air, a jet of the pressurized air hitting the area of the nib and the pad, cooling the pad and inhibiting a dispersion of vapor generated by the surface treatment of the metal surface, and wherein the pressurized air supplying member comprises one of:

a tube that is connected to the body and terminates with a hole oriented towards the nib;

a slit formed in the body near the nib and releasing the jet of air aimed towards the nib; and a deflector formed between the body of the torch and the support for the nib, the deflector having a prevalently radial position, tilted towards the nib and comprising a concave part facing towards the nib, and a hole formed in the body near the deflector releasing the flow of pressurized air against the concave part of the deflector.

* * * * *